US007708130B2

(12) United States Patent
Meyer et al.

(10) Patent No.: US 7,708,130 B2
(45) Date of Patent: May 4, 2010

(54) METHOD FOR TESTING COINS

(75) Inventors: Wilfried Meyer, Buxhtehude (DE); Ulrich Cohrs, Sittensen (DE); Claus Peter Heins, Horneburg (DE)

(73) Assignee: National Rejectors, Inc. GmbH, Buxtehude (DE)

( * ) Notice: Subject to any disclaimer, the term of this patent is extended or adjusted under 35 U.S.C. 154(b) by 0 days.

(21) Appl. No.: 12/210,661

(22) Filed: Sep. 15, 2008

(65) Prior Publication Data

US 2009/0078530 A1 Mar. 26, 2009

(30) Foreign Application Priority Data

Sep. 20, 2007 (DE) ..... 10 2007 046 390

(51) Int. Cl.
*G07D 5/08* (2006.01)

(52) U.S. Cl. ..... 194/318

(58) Field of Classification Search ..... 194/318
See application file for complete search history.

(56) References Cited

U.S. PATENT DOCUMENTS 4,705,154 A 11/1987 Masho et al.
4,717,006 A 1/1988 Chapman
5,263,566 A 11/1993 Nara et al.
5,323,891 A * 6/1994 Waite ..... 194/318
5,871,075 A * 2/1999 Takayama et al. ..... 194/318

FOREIGN PATENT DOCUMENTS

| | | | |
|---|---|---|---|
| DE | 198 36 490 | C2 | 2/2000 |
| DE | 102004013286 | B4 | 11/2005 |
| DE | 68921608 | T2 | 9/2008 |
| EP | 0886247 | B1 | 1/1998 |
| EP | 0978807 | A1 | 9/2000 |

* cited by examiner

*Primary Examiner*—Patrick Mackey
*Assistant Examiner*—Mark Beauchaine
(74) *Attorney, Agent, or Firm*—Vidas, Arrett & Steinkraus, P.A.

(57) ABSTRACT

A method for testing coins which move along a runway, using a coil assembly which, on either side of the runway, has a transmission coil C, D adapted to be admitted by a transmission signal and a reception coil A, B on a common ferrite core wherein the reception coil smaller in diameter is closer to the runway than is the transmission coil and the diameter of the transmission coil is smaller than the diameter of the smallest coin to be assumed, and wherein the ferrite core has arranged thereon a secondary coil coupled to the transmission coil the signal of which is connected, as a negative-feedback signal, to the input of a differential amplifier in such a way that the signal of the transmission coil agrees with the transmitted signal provided to the other input of the differential amplifier.

10 Claims, 5 Drawing Sheets

One-point normalization

A measure is calculated for the curvature of the measuring-point function (attenuation function).

Raw data

| Measuring point | Raw data d | Rest level R | Normalized level N |
|---|---|---|---|
| 1 | 20 | 80 | 120 |
| 2 | 70 | 80 | 120 |
| 3 | 97 | 80 | 120 |
| 4 | 110 | 80 | 120 |
| 5 | 115 | 80 | 120 |

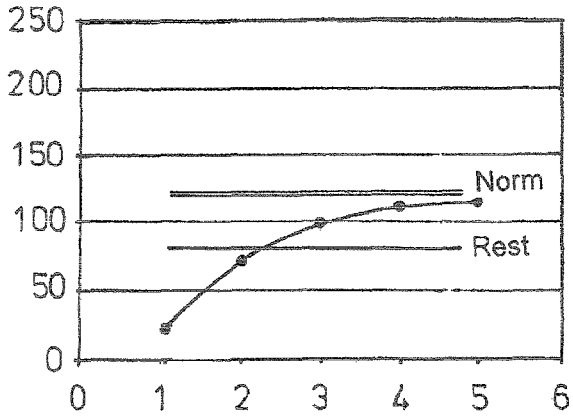

Step 1:

Shift from rest level ---> Normalized level

| Measuring point | Raw data d | Step 1 da |
|---|---|---|
| 1 | 20 | 60 |
| 2 | 70 | 110 |
| 3 | 97 | 137 |
| 4 | 110 | 150 |
| 5 | 115 | 155 |

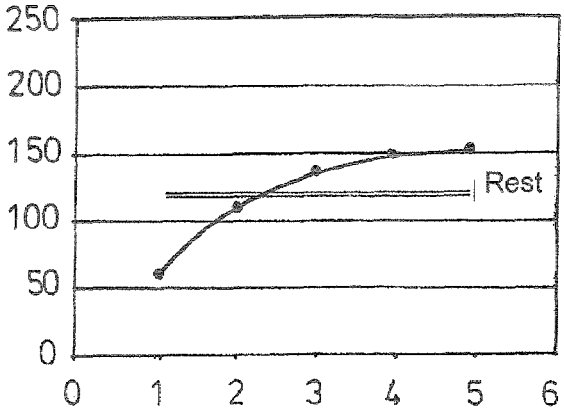

Step 2: Normalization of distance between measured value 1 and rest level to 100, for example k = 1,6667

| Measuring point | Raw data d | Step 2 da |
|---|---|---|
| 1 | 20 | 20 |
| 2 | 70 | 103,333 |
| 3 | 97 | 148,333 |
| 4 | 110 | 170 |
| 5 | 115 | 178,333 |

Normalized value measured

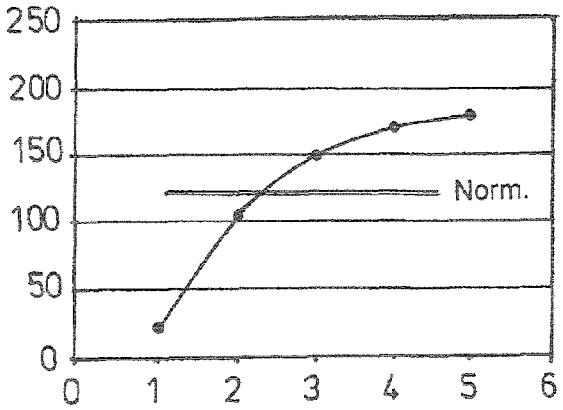

FIG.7

Two-point normalization

A measure is calculated for the curvature of the measuring-point function (attenuation function)

Raw data

| Measuring point | Raw data d | Rest level R | Normalized level N |
|---|---|---|---|
| 1 | 20 | 80 | 120 |
| 2 | 70 | 80 | 120 |
| 3 | 97 | 80 | 120 |
| 4 | 110 | 80 | 120 |
| 5 | 115 | 80 | 120 |

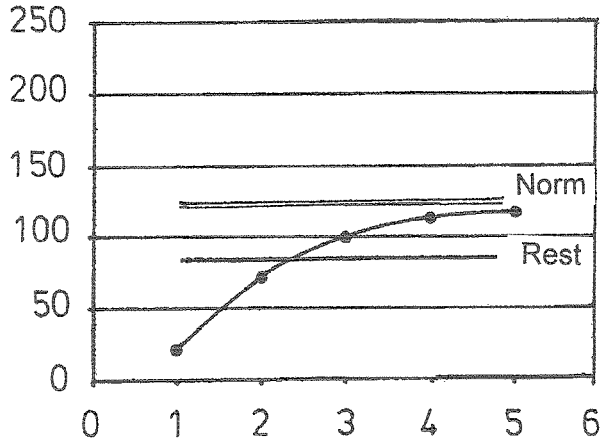

Step 1:

Shift from measured value 1 to zero mark

| Measuring point | Raw data d | Step 1 da |
|---|---|---|
| 1 | 20 | 0 |
| 2 | 70 | 50 |
| 3 | 97 | 77 |
| 4 | 110 | 90 |
| 5 | 115 | 95 |

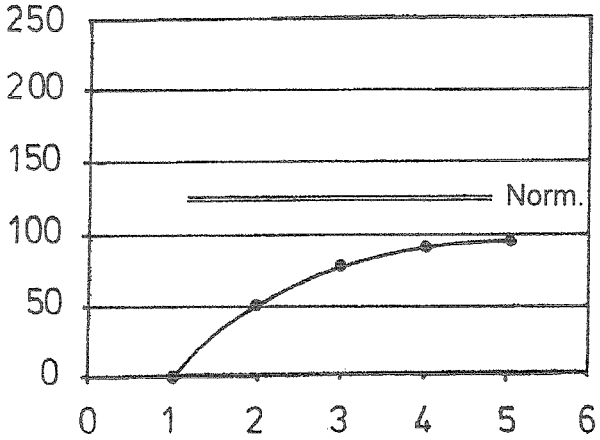

Step 2: Normalization of distance between measured value 1 and measured value 2 to 100, for example k = 2

| Measuring point | Raw data d | Step 2 da |
|---|---|---|
| 1 | 20 | 0 |
| 2 | 70 | 100 |
| 3 | 97 | 154 |
| 4 | 110 | 180 |
| 5 | 115 | 190 |

Normalized value measured

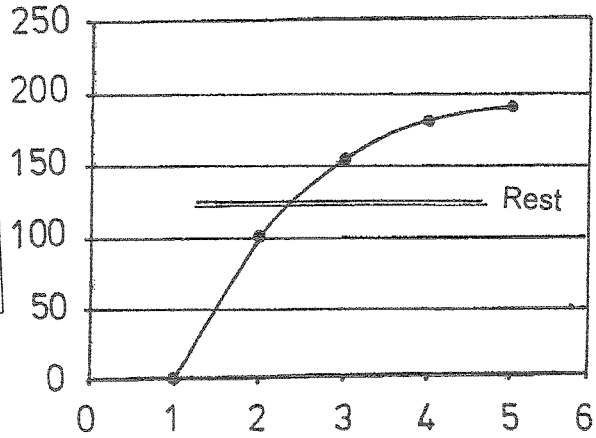

FIG.8

METHOD FOR TESTING COINS

CROSS-REFERENCE TO RELATED APPLICATIONS

Not applicable

STATEMENT REGARDING FEDERALLY SPONSORED RESEARCH

Not applicable

BACKGROUND OF THE INVENTION

Specifically, the invention relates to a method for testing coins using the inductive measuring technique. This technique generally relies on the fact that a magnetic signal is directed from a transmission coil onto a coin running along a runway and a reception coil receives the resultant signal. The signal transmitted undergoes a more or less pronounced attenuation which depends on the material composition of the coin. Further, it is generally known to arrange the reception coil both on the same side as the transmission coil (DE 10 2004 013 286 B4), the entire contents of which is incorporated herein by reference, and the opposite side (DE 689 21 608 T2), the entire contents of which is incorporated herein by reference. From DE 10 2004 013 286 B4, it is also known to dispose a single reception coil on a single ferrite core and arrange the reception coil in a coaxial annular recess of the ferrite core at the front-end side facing the coin runway, the dimensions of the transmitter and reception coils being chosen so that the reception coil is permeated by a substantially homogeneous magnetic field of the transmission coil. Such an arrangement helps in testing coins at a sufficiently high resolution across the thickness of the coin with fluctuations of coin distances not having a particularly adverse effect.

For an arrangement described last, DE 198 36 490 C2, the entire contents of which is incorporated herein by reference, has made it known to provide a secondary coil next to the transmission coil that is coupled to the transmission coil. The signal of the secondary coil is applied to the second input of a differential amplifier to which the transmitted signal will get. The signal of the secondary coil is switched in such a way that the signal of the secondary coil agrees with the signal transmitted. The voltage induced in the secondary coil acts as a negative-feedback signal and causes the voltage induced in the primary coil to be equal to the voltage by which the primary coil is driven (transmitted signal). When under no load, the reception coil will thus be flown through by the same magnetic flux as is the primary coil, which causes the induced voltage in this coil to have the same curve shape as that in the transmission coil. A circuit configuration of this type, however, is also suited for an inductive measurement set-up in which the transmission coil and reception coil are disposed on different sides of the coin runway. In this case, the speech is of a transmissive measurement while a measurement on a single side only is called a reflective measurement.

The generation of a suitable transmission signal as is described in DE 198 36 490 C2 primarily is of significance for a so-called multi-frequency measurement as is described in EP 0 886 247 B1, the entire contents of which is incorporated herein by reference. In this measuring method, a periodically recurrent portion of the transmitted signal is subdivided into a number of switching steps. Envelopes are formed from the values of the signal received by the reception coil in the respective switching steps which are repeated with the frequency of the transmitted signal. An evaluation device forms at least one criterion from the number of the simultaneously generated envelopes for the generation of the acceptance or rejection signal. This measuring method is based on the findings that attenuation curves as are generated by a coin passing through the measuring device are significantly frequency-dependent. The depth of penetration is far larger in case of low frequencies than in case of high frequencies. If frequencies are very high it is known that a so-called skin effect is produced where the depth of penetration is close to zero. In the known measuring method, use is made of the property of a rectangular signal, for example, which is composed of a multiplicity of harmonics. In the portion of the rectangular signal close to its ascending edge, the signal shape of the reception coil is substantially governed by the high frequency fractions.

The signal shape is preponderantly determined by the lower frequency fractions when the number of switching steps increases.

It is also known from the initially mentioned DE 689 21 608 T2 to choose a coil assembly on the two sides in which two coils each on each side are disposed on a common core. A first transmission coil generates a signal which is received by the reception coils on either side of the coin runway. On the other side of the coin runway, the second transmission coil subsequently generates a signal which is received again by the two reception coils.

It is the object of the invention to provide a method for testing coins which allows a particularly good discrimination of most varied coin designs from forged coins.

BRIEF SUMMARY OF THE INVENTION

The inventive method relies on a certain assembly of measuring coils. Either side of the runway has disposed thereon a transmission coil and a reception coil on a ferrite core. The diameter of the reception coil which is closer to the runway than is the transmission coil is smaller than that of the transmission coil, e.g. at a ratio of 1 to 2. The diameter of the transmission coil is smaller than the diameter of the smallest coin to be assumed. The ferrite core has arranged thereon a secondary coil coupled to the transmission coil the signal of which is coupled back, as a negative-feedback signal, to the reception coil. This is intended to achieve that a constant transmission signal can be provided to the reception coil. As was explained already hereinbefore this method has become known from DE 198 36 490 C2. Reference is specifically made to this document. The layout of the transmission coil and reception coil may be provided, for example, in a way as is described in DE 10 2004 013 296 B4, the entire contents of which is incorporated herein by reference, which was mentioned before.

The generation of signals to be transmitted and processing of signals received are similar in a way described in EP 0 886 247 B1. A transmission signal which includes harmonics is periodically generated. For instance, this is a rectangular or triangular signal. During a predetermined measurement interval of periodically recurring portions of the signal transmitted, the amplitudes of the attenuating function are determined from the input signals of the respective reception coil at three different measuring times, as a minimum.

At least four measurement cycles are successively passed through in time. A reflection measurement each is carried out using a transmission coil and a reception coil on either side of the runway. Here, the transmission coils are driven on either side and the signals received by the reception coils are evaluated on either side. Furthermore, two transmission measurements are made where the signals of each reception coil located opposite the transmission coil is evaluated. The specific feature is that the reception coil is constituted by a transmission coil in one case. The order of reflection and transmission measurements may be chosen arbitrarily. The values measured in the four measurement cycles are correlated to each other and/or are compared to predetermined reference values.

Since the reception coils (except for the case where a transmission coil is used as a reception oil) are clearly different in diameter as compared to the transmission coils in the inventive method it is possible to evaluate curve shapes which were determined concurrently and independently as a discrimination criterion, e.g. in the case of circularly disposed bicolor coins. The curve shapes will vary in conformity to the electric and magnetic properties of the ring and core materials.

In the event that a transmission coil is used as a reception coil a curve shape is obtained which is suited better for a determination of the centric position of the coil in the coil assembly, in the case of maximum attenuation in a comparison to the reception coils otherwise used.

The inventive method is not only suited for discriminating counterfeit coins from genuine ones, but also for classifying the denominational values of the coins inserted.

In a preferred aspect of the invention, the coins are moved along so as to bear on a wall of the runway and the coil assembly associated with the wall defines the receiver side during a transmission measurement.

In another preferred aspect of the invention, the values measured during the four cycles are normalized prior to evaluating the results of measurements. For example, normalization can be carried out by shifting a rest level of the signals received to a normalized level (single-point normalization). As is known the rest level is a condition in which there is no coin in the measuring set-up. The normalized level is a randomly chosen level.

A further normalization may be made by shifting a first value measured in the respective cycle to a zero mark. Following a determination of the values measured or curves of the values that face each other, a better evaluation can be made by spreading out the normalized values measured or the functions of the values measured.

For diameter measurements, for instance, it is known to provide two more probes offset in the runway of the coins that determine the diameter of the coins from the input and output signals of a coin and its speed. According to the invention, a sensor arranged in front of the inductive measuring set-up is able to initiate the signal for starting an inductive measurement. The help by this sensor and/or a further one can also allow determining the relative position of a coin with respect to the inductive measuring set-up in order to measure edge zones of a coin more efficiently, for example. If there are pronounced extreme values of the attenuation curves it also is readily possible to find out a time at which a coin is located centrally towards the measuring set-up. For instance, this serves for testing the core material of a bicolor coin.

BRIEF DESCRIPTION OF THE SEVERAL VIEWS OF THE DRAWINGS

The invention will be explained in more detail below with reference to the drawings.

FIG. 7 shows various tables and curves for the one-point normalization of the results measured.

FIG. 8 shows various tables and curves for the two-point normalization of the results measured in the inventive method.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
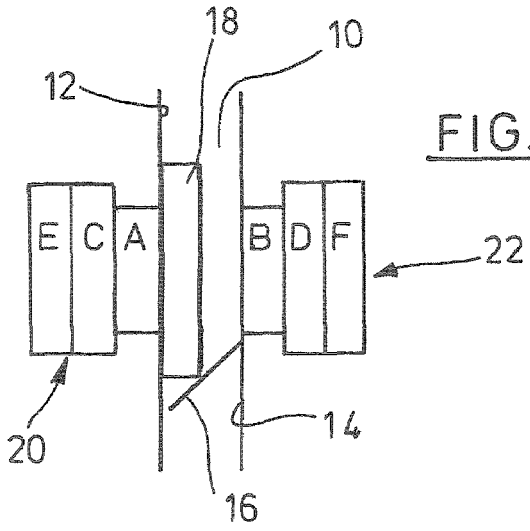
FIG. 1 schematically shows a coin assembly for the implementation of the inventive method.
Figure 2:
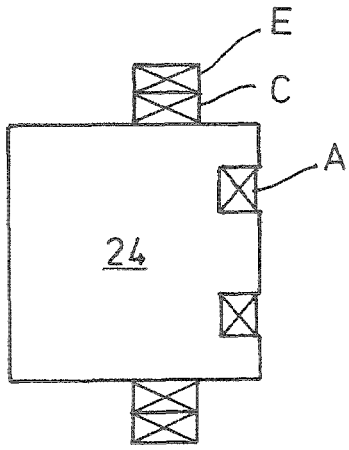
FIG. 2 schematically shows one of the two coin assemblies of FIG. 1.

FIG. 1 illustrates a coin channel 10 having a first wall 12 and a second wall 14. A slanting bottom 16 of the coin channel 10 provides for a coin 18 to be passed along the wall 12. A first inductive measuring set-up 20 is provided on the coin-bearing wall 12 of the coin channel 10 and a second inductive measuring set-up 22 is on the opposite side. The measuring set-up 20 comprises a reception coil A, a transmission coil C, and a secondary coil E. The measuring set-up 22 has a reception coil B, a transmission coil D, and a secondary coil F. The structure of the coil assembly and measuring set-up 20, 22 becomes obvious from FIG. 2.

The transmission coil C and the secondary coil E are disposed on a relatively long ferrite core 24 on the outside thereof. Preferably, coils E and C are wound in a bifilar fashion. The reception coil A is seated in a recess of the ferrite core 24 at a clearly smaller diameter, e.g. half the diameter of the transmission coil C. As is also evident from FIG. 2 the reception coils A and B are located directly on the coin channel 10.

Figure 3:
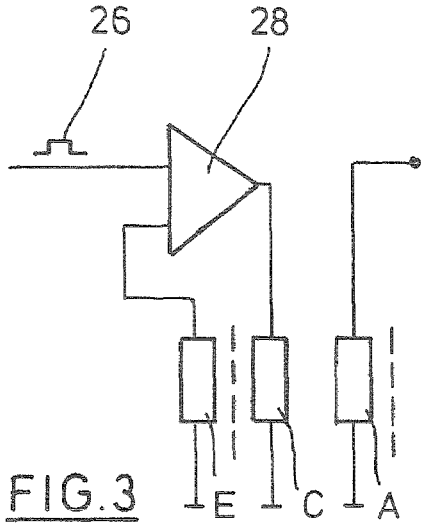
FIG. 3 shows the circuit configuration of the coin assembly of FIG. 2.
Figure 4:
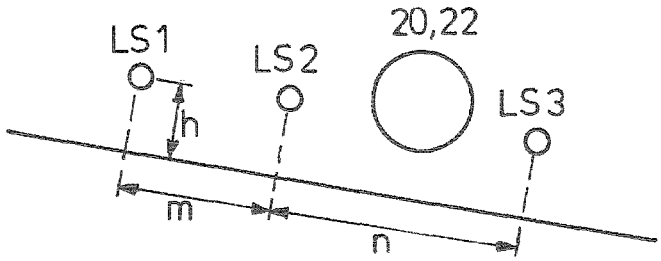
FIG. 4 shows the arrangement of an inductive measuring set-up for the implementation of the inventive method, and three more measuring probes or sensors.

An electric circuitry of the measuring set-up 20 can be seen from FIG. 3. A rectangular signal 26 reaches an input of a differential amplifier 28 which feeds the transmission coil C. The transmission coil C is inductively coupled to the secondary coil E and its output is passed to the second input of the differential amplifier 28. The signal of the secondary coil E is sent, as a negative-feedback signal, to the differential amplifier 28 such as to make the signal of the secondary coil E agree with the signal transmitted.

Figure 5:
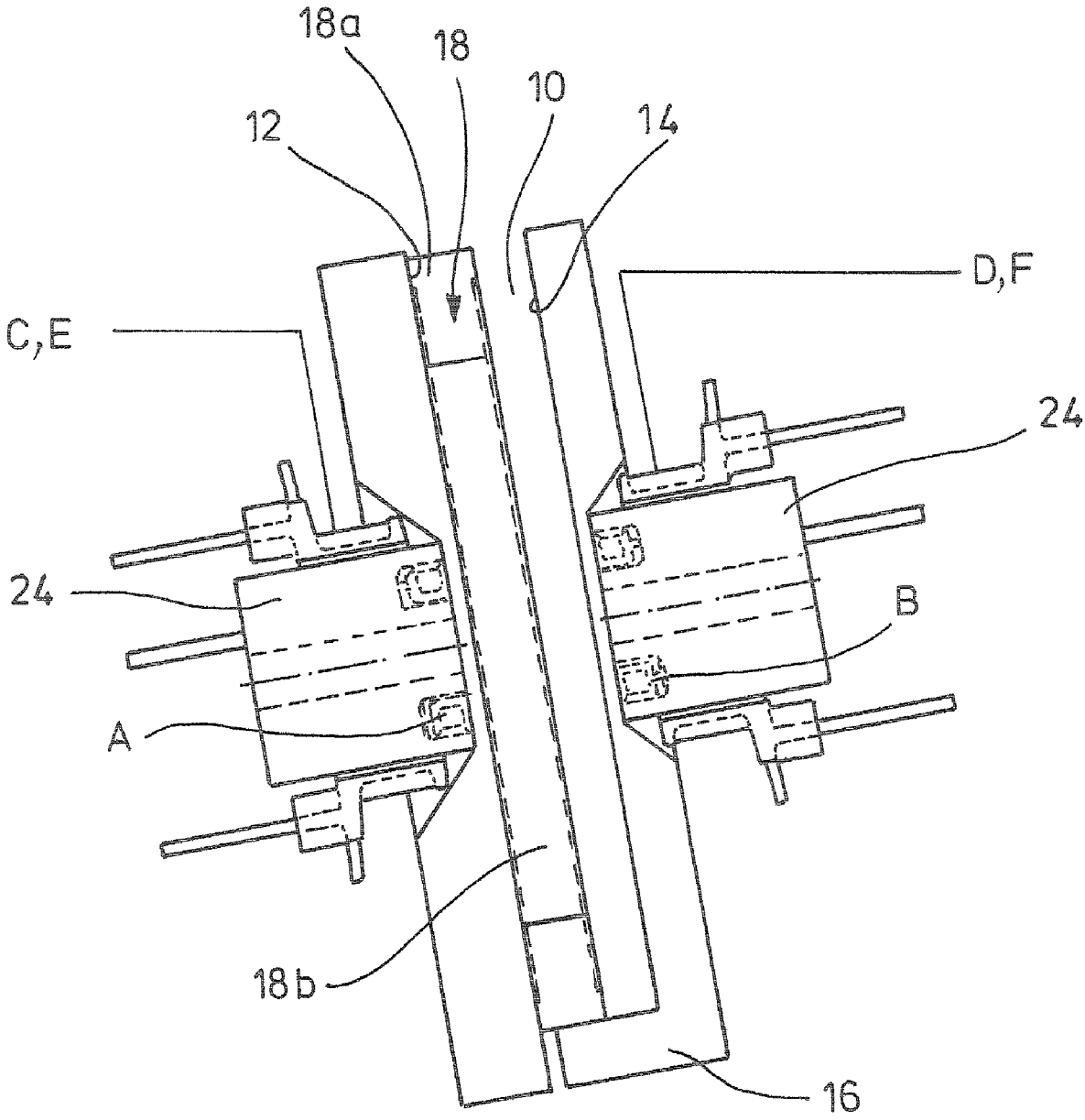
FIG. 5 shows an inductive measuring set-up of FIG. 1 in a more detailed design.

The constructional aspect of the assembly of FIG. 1 emerges from FIG. 5. Components identical to those of FIG. 1 are given the same reference characters. The measuring set-up of FIG. 1 is illustrated in its construction in FIG. 5. The coin 18 is a bicolor coin having a border 18*a* and a core 18*b*. The coin moves along the wall 12 of the main plate in which the first coil assembly 20 is disposed, the transmission coil A being very close to the wall 12.

The measuring set-up as illustrated in FIGS. 1 and 5 provides for a repeated passage in succession through four measurement cycles. The cycle of a measuring signal, e.g. a rectangular signal, is 300 μs, for example, with a pulse being 50 μs in length and the off-time taking 250 μs. Hence, four times 300 μm are needed for a passage through four cycles. Therefore, the interval between the measuring points for measuring the four cycles is 1.2 milliseconds. If the typical time for a passage of a coin through the measuring set-up is about 70 to 80 milliseconds the four values measured in the four cycles will constitute a direct sequence and, hence, represent a measurement of material properties of the coin approximately at the same location.

Shown below is an example of four cycles using the measuring set-up of FIGS. 1 and 5:

| | Cycle | | | |
|---|---|---|---|---|
| | 1 | 2 | 3 | 4 |
| Designation | RA | RB | TC | TA |
| Transmission coil | C | D | D | D |
| Reception coil A | B | C | A | |

As emerges from the table the transmission coil C is activated in the first cycle while the transmission coil D is activated in the other three cycles. In cycles 1 and 4, it is the reception coil A which generates the values to be measured whereas the reception coil B generates the measurement signal in cycle 2 and C is the reception coil in cycle 3.

The respective transmission coil receives a rectangular signal according to the multi-frequency principle as was described already in conjunction with EP 0 886 247 B1. Specific reference to this document is explicitly made.

It can be recognized that the reflection principle is adopted in the first two cycles 1 and 2 and the transmission principle is in cycles 3 and 4.

Each cycle is capable of generating an arbitrary number of measurement values, e.g. 10, by splitting up the transmission pulse appropriately.

Here, the first measurement value is not determined at the time t=0 of the transmission pulse, but only after a preset offset in time in order that a stable condition of the amplifiers be ensured.

Thus, 4×10 measurement values are generated which can be used for classification and evaluation in the preferred case of 4 cycles.

However, it is sufficient to choose measurement values only at certain scanning times, e.g. at the scanning times 1.3 and 9 or 1.2 and 9 or the like. This is because the directly adjacent scanning times partially yield redundant measurement values so that the number of reference values requiring storage may be reduced in this way.

Figure 6:
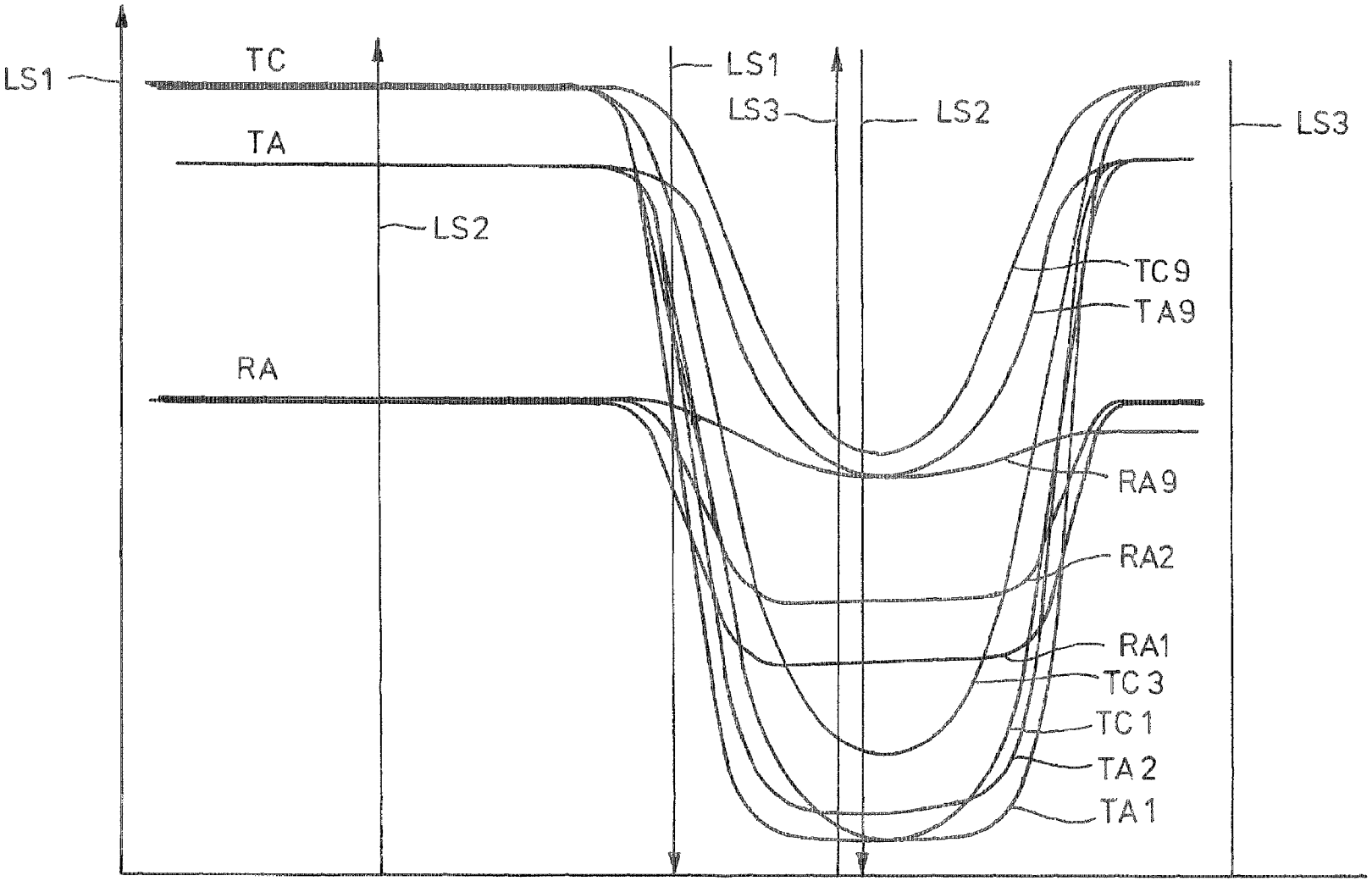
FIG. 6 shows three attenuation curves each of three measurement cycles of an inductive measuring set-up of FIGS. 1 and 5.

In FIG. 6, three attenuation curves each are plotted for the cycles RA, TC, and TA. For the cycle RA, those are the attenuation curves for the switching steps 1, 2 and 9. Regarding the attenuation curves TC, this applies to the switching steps 1, 3 and 9. Regarding the cycle TA, the attenuation curves for the switching steps 1, 2, and 9 are plotted. Moreover, the times in the graph at which a coin reaches or leaves one of the sensors LS1, LS2, and LS3 are plotted by means of the vertical arrows LS1, LS2, and LS3. An upwardly directed arrow indicates that the coin reaches a sensor and a downwardly directed arrow indicates that the coin leaves it. The sensors LS1 to LS3 are photoelectric barriers, for instance, where the transmitter and receiver are disposed on the same side, e.g. on the main plate of the coin tester, whereas the runway carrier plate has disposed thereon a reflection element which reflects the light of the light transmitter onto the receiver. The photoelectric barrier or the sensor LS1 outputs the starting point of a measurement using the measuring set-up of FIGS. 1 and 3. After the start of a measurement, a rest level will first prevail until attenuation sets in. It can be seen that the minima for the cycle RA are cup-shaped and, thus, are flattened very much so that it is relatively difficult to determine the time at which the coin is located centrically within the measuring set-up. The minimum for the cycle TC clearly is more pronounced. The reason is that a transmission coil is used as a reception coil here. As was mentioned repeatedly the transmission coil is distinctly larger in diameter than are the reception coils of the measuring set-up.

The distance of the sensor LS1 from the measuring set-up is chosen so that the ring-shaped portion of the 2€bicolor coin is positioned to be approximately centric in front of the reception coils.

The downwardly directed arrow LS1 shows that the coin exits in front of the sensor.

Thus, it is possible to measure the property of the border at a time at which the coin border influences the measuring set-up to a large extent. As is known the border of a bicolour coin differs from the core in its material properties. The material of the coin core may be determined efficiently by making a measurement at the time at which the attenuation curve has its minimum. The minimum is determinable in the cycle TA, for instance.

When the coin leaves the sensor area the sensor LS3 generates a signal which can terminate the measuring procedure. The sensors shown may also help in measuring the speed of the coin, e.g. for determining a minimum. Furthermore, a diameter measurement may be performed as is known per sé by means of such sensors.

FIG. 7 gives an example of how to evaluate the values measured from the four cycles described. The example plots five values which were measured on the different switching steps of 1 to 5 for the cycle RA. For example, those are the minima of the curves RA1 to RA5 (not all of them being shown in the graph). The behaviour of such a curve as is illustrated in the uppermost graph conforms to the deformation of a rectangular signal by which the transmission coil C was fed, for example. Furthermore, the rest level R and a normalized level are plotted in the graph.

In the first normalization step, the rest level is shifted onto the normalized level, which causes the curve to be raised (middle graph). In the second step, the distance between the measured value 1 and the rest level is set to approximately 100. This results in a spread-out of the curve as is illustrated in the lowermost graph. The one-point normalization of FIG. 7 depicts that the distance of a certain value measured in the cycle RA, e.g. RA1, from the rest value is normalized.

Such normalization helps eliminate the effect of the air-gap field that results, for example, by the fact that the coin does not run smoothly along a runway wall, but at a spacing therefrom, which spacing may also fluctuate oscillatingly, depending on how the coin moves on the runway.

FIG. 8 illustrates another example of a normalization of values measured, a so-called two-point normalization. Two-point normalization means that the distance is normalized between two certain values measured in the cycle RA, e.g. of RA1 from RA3. At this point, the values measured for five switching steps of a measurement cycle RA, for example, again are plotted in a graph with a rest level and a normalized level (see the uppermost graph). In the first normalization step, the value measured is drawn onto the zero mark. In the second step, the distance between the measured value 1 and measured value 2 is set to 100. It is also in this way that elimination is made of the effect of the air-gap field and, hence, an interfering factor, on a determination of measurement results.

The circuitry by which the individual cycles RA, RB, TC, and TA are controlled is not shown. It can readily be realized. The electronic circuit for generating the signals to be transmitted and processing the signals received is not shown either. It is also understood that further measuring cycles, in addition to the cycles described, can be carried out in which the transmission coil D is the reception coil, for instance, whereas coil C is activated as a transmission coil.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

This completes the description of the preferred and alternate embodiments of the invention. Those skilled in the art may recognize other equivalents to the specific embodiment described herein which equivalents are intended to be encompassed by the claims attached hereto.

What is claimed is:

1. A method for testing coins which move along a runway, using a coil assembly which, on either side of the runway, has a transmission coil C, D adapted to be supplied by a transmission signal through a differential amplifier and a reception coil A, B, transmission coil C, D and reception coil A, B being located on one side of the runway on a common ferrite core (with the transmission coil C and reception coil A on one side and the transmission coil D and reception coil B on the other side of the runway), wherein the reception coil A, B being smaller in diameter than the transmission coil C, D is closer to the runway than is the transmission coil C, D, and the diameter of the transmission coil is smaller C, D is smaller than the diameter of the smallest coin to be tested, and wherein the ferrite core has arranged thereon a secondary coil E, F inductively coupled to the transmission coil so that a signal of which is connected, as a negative-feedback signal, to the input of a differential amplifier in such a way that the signal of the transmission coil C, D corresponds to the transmission signal supplied to the other input of the differential amplifier, the method comprising the steps below:

A transmission signal includes harmonics and is periodically generated;

during a predetermined measuring interval of periodically recurring portions of the transmission signal, amplitudes of the attenuating function are determined from the signals of a respective reception coil A, B at least three different measuring times, at least four measuring cycles are successively passed through in time; during which two reflection measurement each are performed on each side of the runway and two transmission measurements are performed each using a transmission coil and a reception coil on either side of the runway, wherein the each opposite transmission coil is connected also as a reception coil during one of the two transmission measurements, the values measured and the attenuating functions from at least one of the measuring cycles are correlated to each other and/or are compared with predetermined reference values, and coins are sorted based on said measurements.

2. The method according to claim 1, characterized in that the coins are moved along so as to bear on a wall of the runway and the transmission and reception coils facing the wall define the receiver side during a transmission measurement.

3. The method according to claim 1, characterized in that the coins are moved to bear on a wall of the runway and the transmission and reception coils facing away from the wall define the receiver side during the transmission measurement.

4. The method according to claim 1, characterized in that the values measured during the measurement cycles are normalized prior to being compared to reference values.

5. The method according to claim 4, characterized in that said normalization is carried out by shifting a rest level of the received signals to a normalized level.

6. The method according to claim 4, characterized in that said normalization is carried out by shifting a first measured value to the zero mark.

7. The method according to claim 5, characterized in that the normalized values measured and functions of the values measured are spread out.

8. The method according to claim 1, characterized in that at least one measuring probe generates a presence signal, by means of which a relationship is established between measured values and the actual position of the coin with regard to the coil assembly, in the direction of movement in front of the coil assembly.

9. The method according to claim 8, characterized in that the first measurement cycle is started by the signal of a measuring probe.

10. The method according to claim 1, characterized by its application to the secondary coils, wound onto also to the respective ferrite core for the associated transmission coil C, D and reception coil A, B and bifilarly with the transmission coil.

* * * * *